US009574712B2

(12) United States Patent
Wilson et al.

(10) Patent No.: US 9,574,712 B2
(45) Date of Patent: Feb. 21, 2017

(54) SYSTEM AND METHOD OF AUTOMATICALLY ENDING THE FILLING OF A GAS TRANSPORT MODULE OR OTHER GAS TRANSPORT

(71) Applicant: Integrys Transportation Fuels, LLC, Chicago, IL (US)

(72) Inventors: Wesley W. Wilson, Chicago, IL (US); David A. Diggins, Chicago, IL (US)

(73) Assignee: TRILLIUM TRANSPORTATION FUELS, LLC, Wilmington, DE (US)

( * ) Notice: Subject to any disclaimer, the term of this patent is extended or adjusted under 35 U.S.C. 154(b) by 378 days.

(21) Appl. No.: 14/452,901

(22) Filed: Aug. 6, 2014

(65) Prior Publication Data

US 2015/0047738 A1 Feb. 19, 2015

Related U.S. Application Data

(60) Provisional application No. 61/866,314, filed on Aug. 15, 2013.

(51) Int. Cl.

| | |
|---|---|
| ***B65B 31/00*** | (2006.01) |
| ***F17C 13/02*** | (2006.01) |
| ***F17C 5/06*** | (2006.01) |

(52) U.S. Cl.
CPC ..... *F17C 13/025* (2013.01); *F17C 5/06* (2013.01); *F17C 13/026* (2013.01); *F17C 2221/033* (2013.01); *F17C 2265/063* (2013.01)

(58) Field of Classification Search
CPC ..... F17C 5/06; F17C 13/025; F17C 13/026; F17C 2265/065; F17C 2265/063
See application file for complete search history.

(56) References Cited

U.S. PATENT DOCUMENTS

2001/0010239 A1* 8/2001 Mutter ..... F17C 5/007 141/105
2013/0248000 A1 9/2013 Killeen et al.

* cited by examiner

*Primary Examiner* — Jason K Niesz
(74) *Attorney, Agent, or Firm* — Banner & Witcoff, Ltd.

(57) ABSTRACT

Processes and systems are described, which provide important advantages in filling gas storage vessels, such as gas cylinders for the transport of compressed natural gas (CNG). For example, the flow of gas from the fill station may be terminated safely, using an auto-fill shut-off mechanism, without the risk of exceeding vessel pressure ratings and overall reduced risk of operator error. The automatic termination of flow can occur at a preselected pressure that may, for example, be set at a fixed value, or may otherwise be adjusted based on the local temperature at the time of the fill.

20 Claims, 2 Drawing Sheets

SYSTEM AND METHOD OF AUTOMATICALLY ENDING THE FILLING OF A GAS TRANSPORT MODULE OR OTHER GAS TRANSPORT

CROSS-REFERENCE TO RELATED APPLICATIONS

This application is a non-provisional application under 35 U.S.C. §111(a) and claims the benefit of priority under 35 U.S.C. §119(e) to U.S. provisional application No. 61/866,314, filed Aug. 15, 2013, which is hereby incorporated by reference in its entirety.

FIELD OF THE INVENTION

The present invention relates generally to a system and method for filling a gas storage vessel, including multiple vessels that may be part of a gas transport module, with compressed natural gas ("CNG") at a gas transport fill location. Particular aspects relate to a system and method for automatically ending the filling of a gas transport module or other gas transport, for example at a predetermined fill pressure based on the manufacturer's rated gas pressure and temperature.

DESCRIPTION OF RELATED ART

One of the most significant trends in natural gas applications involves the skyrocketing use of compressed natural gas (CNG), namely natural gas that is compressed to less than 1% of the volume it occupies at atmospheric pressure. The demand for CNG continues to expand, as a fuel for fleet vehicles that log high daily mileage (e.g., taxis, buses, and airport shuttles), and medium- and heavy-duty trucks. In addition, CNG use by railroads as a locomotive fuel is gradually gaining acceptance. At businesses worldwide, CNG continues to make significant inroads as a high-value energy resource for manufacturing and operations processes. Specifically, numerous factors related to natural gas in general, including its "green" environmental-impact advantages and its price stability, are driving business to consider CNG as a viable replacement for liquid petroleum-based fuels. Moreover, the reserves for natural gas are becoming ever more established, particularly in the U.S., as a consequence of leveraging new technologies like hydraulic fracturing.

If the market for CNG transportation fueling infrastructure is to grow beyond the current, primary users, namely high fuel use fleets, it will be necessary to accommodate a variety of vehicle classes and fueling needs. This will require fueling infrastructure to become established between cities, counties, regions, and states. Retail and truck stop outlets will need to be developed in numbers that allow reasonably convenient access to CNG, with fueling stations designed to accommodate any size vehicle and fuel demand. It is estimated that between 12,000 and 24,000 CNG public fueling stations, equivalent to 10 to 20 percent of stations for traditional liquid fuels, will make CNG competitive. The major difference between CNG fueling and conventional liquid fueling of vehicles stems from variances in physical properties between gases and liquids, which result in the need for compression and adjustments based on ambient conditions. Natural gas is similarly simple to use, albeit in a different manner from conventional liquid fuels.

In meeting the demand for CNG and its associated infrastructure, manufacturers, distributors, and retailers must first and foremost ensure its safe road/rail/sea transport and on-site storage. In addition, conformance with highly complex and stringent government regulations around the world must be maintained. Since many facilities seeking to make the conversion to CNG from conventional fuels are situated in rural areas outside established pipeline networks, they require that natural gas be transported, in its compressed natural gas (CNG) state, via gas transport modules on tube trailers. These trailers are used, for example, for mother and daughter stations, whereby the CNG is conveyed from the main (mother) fill station to various smaller (daughter) units. Tube trailers can also be used as a natural gas supply source for small communities not served by a natural gas pipeline. In this case, natural gas from a remote pipeline is compressed to 2,500-4,000 psig at the fill station and then loaded into CNG trailers for transport by road. At the delivery point, the pressure of CNG in the trailer is reduced to a level suitable for commercial and industrial applications. If natural gas is used as vehicular fuel, CNG will be maintained or recompressed to 3,000 psig or higher for delivery into vehicle's CNG tanks.

Important challenges for maintaining the pace of the CNG expansion in general relate to addressing safety concerns that are inherent in this industry. The high pressures associated with the efficient transport of CNG pose a number of concerns, including ensuring that pressure vessel ratings, which are dependent on ambient temperature, are not exceeded, particularly when such vessels are filled at fill stations from very high pressure sources. Furthermore, potential risks must be addressed with solutions that are not so complex as to become cost prohibitive. For these reasons, the art is continually in need of methods and systems for safely and efficiently filling gas transport modules, which normally include multiple pressurized tubes and associated equipment, adapted to fill the tubes from a fill station to their proper fill pressures and carry the tubes on a truck trailer. Conventionally, at each fill station, the fill pressure needs to be reset to accommodate different ratings for the different gas storage vessels being filled. This is not only time consuming and impractical, but also subject to operator error.

SUMMARY OF THE INVENTION

The present invention is associated with the discovery of processes and systems that address known problems associated with filling one or more gas storage vessels, such as cylinders used with gas transport modules, by shutting off the flow of gas from the fill station without the risk of exceeding vessel pressure ratings. The termination of flow can occur automatically and at a preselected pressure that may, for example, be set at a fixed value, or may otherwise be adjusted based on the local temperature at the time of the fill, in order to optimize the amount of gas stored in the gas storage vessel(s). Particular aspects of the invention advantageously allow for the accurate and automatic termination of filling a high capacity gas transport module at pressures that differ from the upstream or supply (header) pressure of the fill station. This supply pressure is generally consistent with conventional natural gas vehicle (NGV) rate pressures, with the principal values of 3,000 and 3,600 pounds per square inch gauge (psig) pressure being representative. Supply or upstream pressures, however, can more broadly vary from about 2,000 psig to about 5,000 psig, and may typically be in the range from about 2,500 psig to about 4,500 psig. Importantly, the processes and systems described herein can provide for the safe termination of filling one or more cylinders of a large volume gas transport module, without the use of external power or controls. Particular processes and systems can be carried out and implemented without the requirement for the fill of the transport module to be terminated manually, for example by relying on an operator to determine the appropriate fill pressure and close the fill hose valve at the correct time.

Embodiments of the invention relate to processes for filling one or more gas storage vessel(s), such as one or more cylinders of a gas transport module, which may be adapted to, or configured for, transport on a trailer truck to provide CNG to a remote location. Representative processes comprise connecting the gas storage vessel(s) to a downstream end of a fill assembly, wherein the downstream end is separated from an upstream end by a pressure-actuated inlet valve. Other representative processes do not require a step of connecting, for example in the case in which the gas storage vessel(s) (e.g., as part of a gas transport module) is/are already connected to the downstream end of the fill assembly. The upstream end of the fill assembly may provide an increased supply pressure, which exceeds a reduced, receiving pressure that is provided to the gas storage vessel(s) at the downstream end. The supply pressure may exceed the receiving pressure by generally at least about 50 pounds per square inch absolute (psia) (e.g., from about 50 psia to about 1000 psia), and typically by at least about 100 psia (e.g., from about 100 psia to about 500 psia). The processes further comprise providing a valve-regulating gas to the pressure-actuated inlet valve, at a valve pressure sufficient to cause a flow of product gas (e.g., CNG that is provided at the upstream supply pressure) from the upstream end into the gas storage vessel(s). The valve pressure is controlled based on a comparison between an actual (e.g., measured) pressure and a target storage pressure of the gas storage vessel(s), and the comparison is performed automatically by a valve position controller in fluid communication with the gas storage vessel(s) (e.g., by way of a pressure sensor for determining the actual pressure of the gas storage vessel(s)).

According to particular embodiments, the valve-regulating gas is provided to the pressure-actuated inlet valve during the filling period, as either a flow of gas at the valve pressure, or otherwise provided without flow. In the former case, product gas flow from the CNG supply to the storage vessel may be terminated by stopping the flow of the valve-regulating gas. In the latter case, this product gas flow may be terminated by simply venting the valve-regulating gas from the pressure-actuated inlet valve. Regardless of how the valve-regulating gas is provided, it may be obtained or provided from the storage vessel itself, or otherwise from a supplemental compressed gas source, such as a supplemental gas cylinder (e.g., a cylinder containing nitrogen, air, argon, or $CO_2$). The valve-regulating gas is generally reduced in pressure, from its source, to a pressure suitable for actuation of the pressure-actuated inlet valve.

Further embodiments of the invention relate to systems for filling a gas storage vessel as described above, with system comprising a fill assembly having upstream and downstream ends, as well as a connection for the gas storage vessel(s) at the downstream end. A pressure-actuated inlet valve separates the upstream and downstream ends, and is also configured to receive a valve-regulating gas at a valve pressure that causes a flow of product gas, as described above, from the upstream end into the gas storage vessel(s). A valve position controller in fluid communication, or at least configured for fluid communication, with the gas storage vessel(s) is configured to automatically control the valve pressure, based a comparison between an actual (e.g., measured) pressure and a target storage pressure of the gas storage vessel(s). According to particular embodiments, the systems may comprise separate, first and second ports at the upstream end, for providing product gas at higher and lower pressures (e.g., higher pressures in the range from about 3,350 psig to about 4,300 psig, and lower pressures in the range from about 2,750 to about 3,250 psig), respectively. The pressure actuated inlet valve may be configured to cause a flow of the product gas from the first port only, for example, in cases where only the first port provides product gas at a pressure that exceeds the rating of the gas storage vessel(s).

Yet further embodiments of the invention relate to computer program products, and particularly those for providing automated control in the processes described herein, and/or in conjunction with the systems described herein. According to such embodiments, a non-transitory computer readable medium has a computer program stored thereon, including instructions for causing a processor to perform the steps of (a) receiving, during a filling period of a gas storage vessel(s), a signal representative of an actual (e.g., measured) pressure of the gas storage vessel(s), and (b) comparing the actual pressure to a target storage pressure of the gas storage vessel(s), and, in the case of the actual pressure meeting or exceeding the target storage pressure, transmitting a signal to depressurize a pressure-actuated inlet valve, which terminates the flow of product gas, as described above, to the gas storage vessel(s). In particular, the flow may be terminated when the valve pressure is reduced below a valve threshold pressure, as needed to actuate the pressure-actuated inlet valve. The target storage pressure, which may be an input to the processor, may be dependent on another input to the processor, such as a measured ambient temperature.

It should therefore be appreciated that the methods described herein may be carried out by a processor (e.g., of a computer) in conjunction with devices (e.g., valves and controllers) that receive signals based on information obtained from, or calculated by, the processor. Representative methods may be carried out by a processor in combination with analog and/or digital devices, for example a pressure switch that interrupts a circuit at a pre-defined target storage pressure, in conjunction with a relay that causes termination of a filling period by, for example, depressurizing a pressure-actuated inlet valve. As described herein, such a depressurization may be due to the interruption of valve gas flow, or the venting of valve gas pressure, supplied to the inlet valve.

These and other embodiments and aspects relating to the present invention are apparent from the following Detailed Description.

BRIEF DESCRIPTION OF THE DRAWINGS

A more complete understanding of the exemplary embodiments of the present invention and the advantages thereof may be acquired by referring to the following description in consideration of the accompanying figures, in which the last two digits of reference numbers in the figures indicate the same or similar features and wherein:

FIGS. 1 and 2 should be understood to present an illustration of the invention and principles involved. Simplified systems and process flows are depicted, and some components may be distorted/enlarged relative to others, in order to facilitate explanation and understanding. Optional equipment and other items not essential to the understanding of the invention, which may include some instrumentation, some process lines, heaters and coolers, etc., are not shown. As is readily apparent to one of skill in the art having knowledge of the present disclosure, processes and associated equipment for carrying the filling of gas storage vessels, according to various other embodiments of the invention, will have configurations and components determined, in part, by their specific use.

DETAILED DESCRIPTION

According to exemplary embodiments, the invention allows for the filling of gas storage vessel(s), such as one or more cylinders of a gas transport module, to a preselected pressure, after which the fill may be terminated by closing a valve and thereby preventing the further flow of gas such as CNG from the fill station into the gas transport module. The processes can be carried out, and the systems operated, advantageously using residual gas pressure in the gas transport module. Alternatively, the processes and systems can use gas pressure from another source to actuate the fill valve, including but not limited to the air supply from the transport trailer brakes, or a cylinder containing a compressed gas such as air. According to particular embodiments, the gas transport module may be associated with, or have equipment for coupling to, a trailer or other means (e.g., a freight train car or cargo ship bed) for conveying pressure storage vessels from one location to another. The gas transport module, and in particular the one or more cylinders used with such a module, are generally refillable after use (e.g., after delivery of the product gas, such as CNG, to a customer, such as a CNG fueling station). The storage vessels may have a manufacturer's recommended fill pressure that is based on (i.e., varies according to) the fill or operating temperature of the storage vessel. The recommended fill pressures will vary with vessel design, materials used in the storage vessel, and manufacturing techniques.

Figure 1:
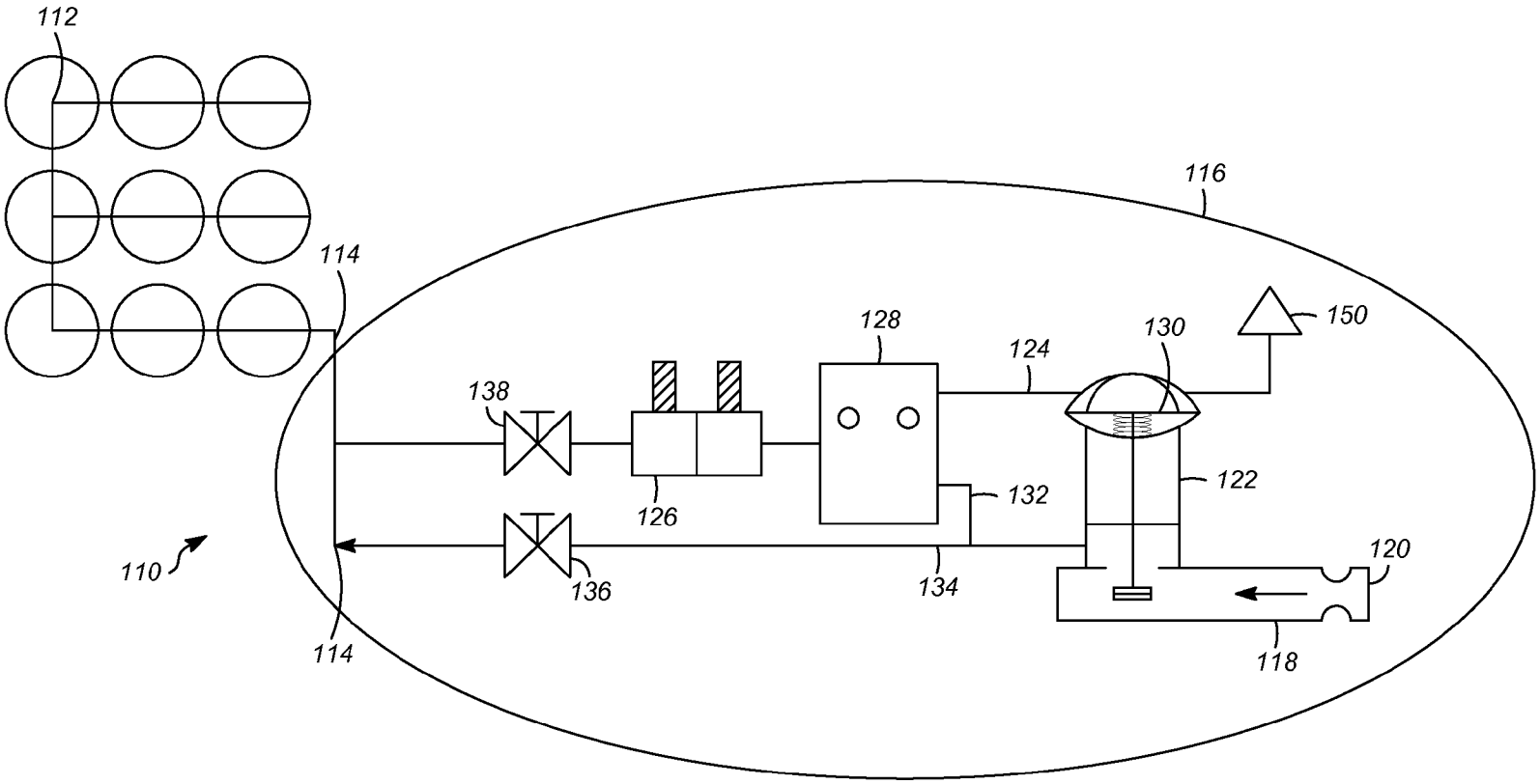
FIG. 1 depicts an embodiment of a system that can be used to carry out processes as described herein, for filling gas storage vessel(s), such as one or more cylinders of a gas transport module.

FIG. 1 depicts a representative gas transport module 110 including a plurality of gas transport storage vessels 112 connected to downstream end 114 of system 116 for filling storage vessels 112. More specifically, transport module 110 is connected to the fill hose (not shown) of a fill station supplying CNG at a representative supply pressure, for example in the range of about 2,500 psig to about 4,500 psig. This connection with the fill hose at upstream end 118 of system 116 occurs at fill port 120 that is rated to a fill pressure at least equal to that of the gas transport storage vessels 112. Therefore, downstream end 114 is configured to connect gas transport storage vessels at a reduced, receiving pressure, that is below the increased supply pressure at which upstream end 118 is configured to connect to the fill station supplying CNG. Separating these upstream and downstream ends 114, 118 is pressure-actuated inlet valve 122, supplied with valve-regulating gas 124. Pressure-actuated inlet valve 122 therefore serves as an auto-fill shut-off mechanism that may be provided, during a filling period, with this valve-regulating gas as a valve gas flow, for example at a constant flow rate within a range from about 0.1 to about 25 standard cubic feet per hour ($ft^3$/hr), and more typically from about 1 to about 10 $ft^3$/hr. According to the embodiment in FIG. 1, valve-regulating gas 124 is provided from the gas transport storage vessels 112, and more specifically as residual gas having a pressure of at least that representative of a near empty pressure of gas transport storage vessels 112, for example at least a pressure in the range from about 25 psig to about 150 psig. The pressure of valve-regulating gas 124 at pressure-actuated inlet valve 122 (i.e., the valve pressure), during the filling period, must be sufficient to actuate, i.e., open, pressure-actuated inlet valve 122, causing a flow of CNG or other product gas from upstream end 118 to downstream end 114 and consequently into gas transport storage vessels 112. The valve pressure may be maintained, for example, using a pressure regulator such as two-stage regulator 126 that steps down the pressure of gas transport storage vessels 112 to some constant pressure (e.g., within the range from about 25 psig to about 150 psig) that is below the changing (increasing) pressure of gas transport storage vessels 112 but nevertheless at a valve pressure sufficient to actuate pressure-actuated inlet valve 122.

In this manner, valve regulating gas is provided during the filling period as a valve gas flow at a valve pressure, as described above, for a time suitable for increasing the pressure of gas transport storage vessels 112 from nearly empty to a target storage pressure or recommended fill pressure. A valve position controller 128 is used to terminate the fill when the proper pressure is reached, by automatically performing a comparison between the actual, for example measured, pressure of gas transport storage vessels 112 and the target storage pressure. According to the particular embodiment of FIG. 1, valve position controller 128 provides a constant valve gas flow (e.g., at 5 $ft^3$/hr) at a constant valve pressure (e.g., 75 psig), as long as the actual pressure of gas transport storage vessels is below the target storage pressure. The valve pressure is sufficient to hold pressure-actuated inlet valve 122 in an open position, for example due to valve-regulating gas 124 being provided to, or pressurizing, a first (e.g., top or valve gas) side of diaphragm 130 of pressure-actuated inlet valve 122, with the first side being opposite a second (e.g., bottom or product gas) side of diaphragm 130. Valve-regulating gas, after flow through the first side of diaphragm 130 to pressurize this side to a sufficient pressure to actuate valve 122, may be passed to vent 150.

The actual pressure of gas transport storage vessels 112 may be provided to valve position controller 128 by way of reference line 132 in fluid communication with downstream end 114 that is connected to gas transport storage vessels 112. As shown in FIG. 1, reference line 132 may be a side stream of storage vessel fill line 134, taken downstream of pressure-actuated inlet valve 122 (and therefore having the reduced, receiving pressure of gas transport storage vessels 112) and upstream of manual shut-off valve 136 on storage vessel fill line 134. A second manual shut-off valve 138, upstream of regulator 126, may be used in combination with manual shut-off valve 136 to isolate fill system 116 from gas transport storage vessels 112. When the pressure of reference line 132 (and consequently the pressure delivered to valve position controller 128) reaches or exceeds the target storage pressure of gas transport storage vessels 112, an action or signal of valve position controller 128 stops or removes valve gas flow provided by valve-regulating gas 124. This action or signal automatically terminates the filling period, since the valve pressure sufficient to maintain pressure-actuated inlet valve 122 in an open position is no longer provided. In this manner, valve position controller 128 may itself have shut-off capability, with respect to valve-regulating gas 124. According to the particular embodiment of FIG. 1, therefore, valve position controller 128 is in fluid communication with both gas transport storage vessels 112 and pressure-actuated inlet valve 122 (or at least the first, valve gas side of diaphragm 130 of this valve) and directly regulates the valve pressure, for example by maintaining or stopping the flow of valve-regulating gas 124, or, more generally, by pressurizing or depressurizing pressure-actuated inlet valve 122. Rather than such direct regulation, it is also possible for valve position controller 128 to remotely regulate the valve pressure, for example by signaling an auxiliary flow valve to maintain or stop the flow of valve-regulating gas, or otherwise signaling an auxiliary vent valve to pressurize or depressurize pressure-actuated inlet valve 122 (e.g., by closing or opening the auxiliary vent valve, respectively).

It should be understood that the disclosed pressures and flow rates, associated with the operation of pressure-actuated inlet valve 122 in the embodiment of FIG. 1 are exemplary, and the invention may be more broadly practiced with other pressures and flow rates that are supplied to, or removed from, pressure-actuated inlet valve 122. The valve position controller 128 may be set to stop or remove valve gas flow and/or valve gas pressure, provided by valve-regulating gas 124, at a specific pressure of reference line 132. Otherwise, the "trigger pressure," or pressure of reference line 132 at which valve gas flow and/or valve gas pressure is removed, can also be set based on the ambient conditions during a particular filling period, to compensate for the tank manufacturer's rating, for example 3,250 psig at 70° F. The target storage pressure may, in particular, be based on (i.e., may be dependent on) a measured, ambient temperature.

Figure 2:
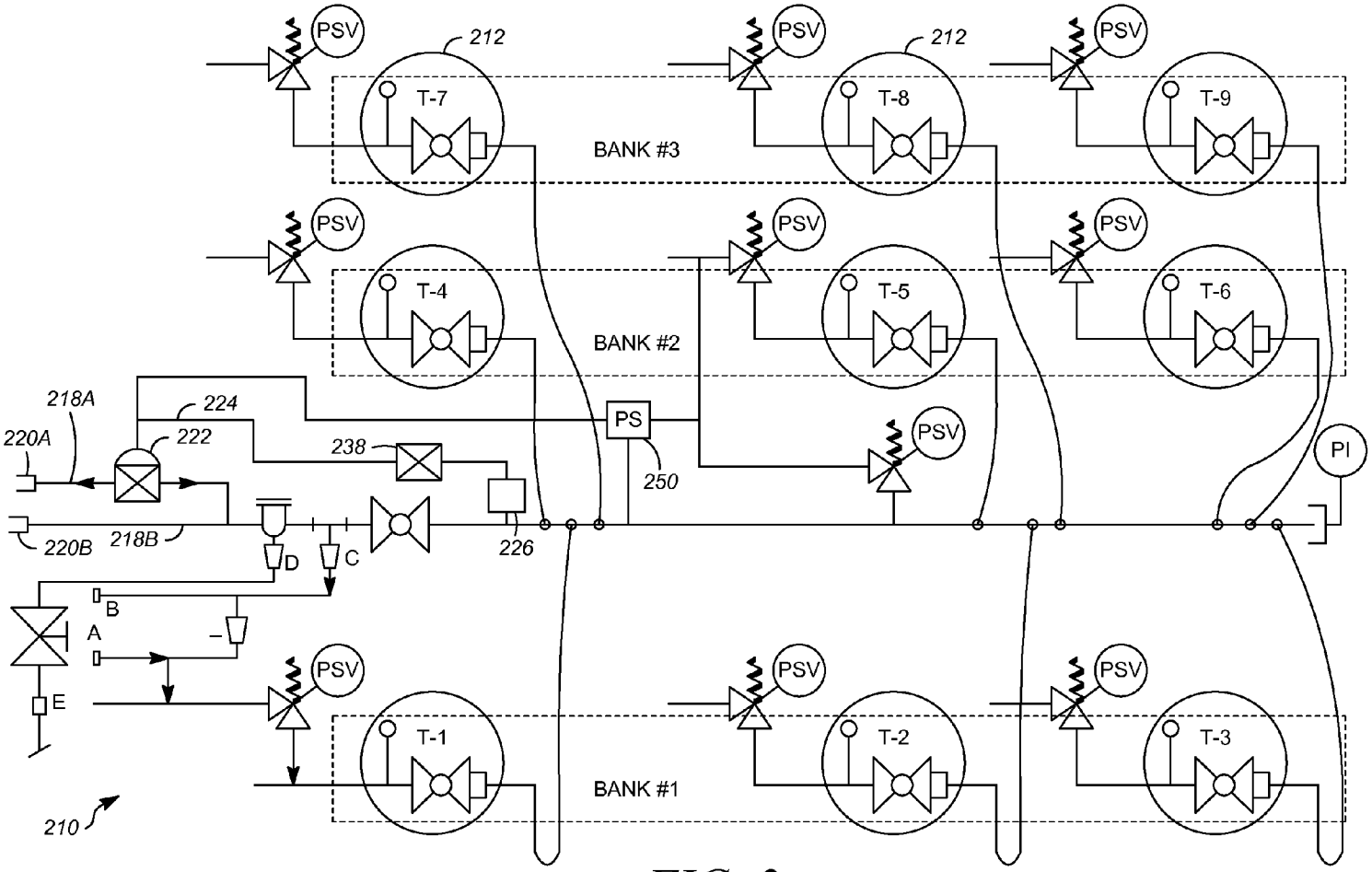
FIG. 2 depicts an alternative embodiment of a system as described herein.

According to FIG. 2, an alternative embodiment is depicted, in which a gas transport module 210, comprising a plurality of gas transport storage vessels 212, is filled to a predetermined pressure, for example a target storage pressure. The filling period is terminated by closing a valve, for example a pressure-actuated inlet valve 222, or fill valve, preventing the flow of gas from the fill station into the transport. As in the embodiment depicted in FIG. 1, the gas transport module 210 may operate using a residual gas pressure in the gas transport storage vessels 212, but could also use gas pressure from another source to actuate the fill valve. The other source may include, but is not limited to, an air supply for pneumatic trailer brakes or other supplemental compressed gas source, such as a cylinder containing a compressed gas such as air. In addition, as in the embodiment depicted in FIG. 1, gas transport module 210 may be adapted to, or configured for, transport on a trailer truck to convey gas transport storage vessels 212 from one location to another. The one or more gas storage vessels would need to be refilled after delivering CNG to a customer. Gas transport module 210 is connected to a fill hose through a fill port that is at least rated to a fill pressure equal to that of gas transport storage vessels 212.

In the embodiment of FIG. 2, two fill ports, namely first and second fill ports 220*a*, 220*b*, provide product gas at upstream ends 218*a*, 218*b*, at higher and lower pressures, respectively. These pressures may, for example, match two predominant fill pressures of CNG fueling stations in the United States, namely 3,600 psig (in the case of fill port 220*a*) and 3,000 psig (in the case of fill port 220*b*). First and second fill ports 220*a*, 220*b* may have different sizes and/or shapes, in order to ensure that gas is supplied to these fill ports using compatible fill hose connections that are specific for a given supply pressure or range of supply pressures. According to the embodiment of FIG. 2, when the fill hose is connected to the second (e.g., 3,000 psig) fill port 220*b*, no means of controlling the fill is required, provided the gas transport vessel maximum pressure is at least 3,000 psig. Therefore, pressure actuated inlet valve 222 may be configured to cause flow of product gas from first fill port 220*a* only. Use of second fill port 220*b* enables fueling of gas transport storage vessels 212 to the maximum safe pressure, optimized for local ambient conditions (e.g., temperature) at the time of fueling, provided that the CNG fueling station supplying gas compensates for ambient temperature. When the fill hose is connected to first fill port 220*a* to supply CNG product gas at a pressure of greater than about 3,000 psig (e.g., at 3,600 psig supply pressure), an auto-fill shut-off mechanism, namely pressure-actuated (e.g., air-operated) inlet valve 222 prevents filling of gas transport storage vessels 212 beyond the target storage pressure, which may be a pre-determined maximum pressure that is equal to or lower than 3,600 psig. The target storage pressure may be compensated for, or adjusted based on, ambient temperature. A target storage pressure may be increased or decreased, respectively, as ambient temperature increases or decreases. This adjustment may be according to an ideal gas factor that is the ratio of the absolute ambient temperature to an absolute reference temperature, for example 530° Rankine (° R), which corresponds to a reference temperature of about 70° F.

According to representative embodiments, the auto-fill shut-off mechanism is a normally-closed air operated valve. To open the valve, pressurized gas or air at a valve pressure within the ranges described above (e.g., from about 25 psig to about 150 psig), but preferably less than about 120 psig, is supplied to the valve. When pressure is vented, the valve automatically closes.

In the case of the embodiment according to FIG. 2, therefore, the pressurized gas (e.g., provided from gas transport storage vessels 212 as described above) or air serves as the valve-regulating gas, which in this case may be provided during the filling period at the valve pressure without flow (i.e., as a stagnant source of pressurized gas, acting on pressure-actuated inlet valve 222 to maintain it in the open position, thereby supplying CNG product gas during the filling period). For example, pressure regulator 226, in fluid communication with gas transport storage vessels 212 can provide a constant valve gas pressure in a range as described above, with a representative value being 100 psig (nominal), to the pneumatic line of pressure-actuated inlet valve 222. Normally-closed momentary (or manual) valve 238 may be opened or actuated by an operator to pressurize the pneumatic line supplying valve-regulating gas 224 that opens pressure-actuated inlet valve 222. When the actual pressure in gas transport storage vessels 212 reaches or exceeds the set point or target pressure, the filling period is automatically terminated by an action or signal from the valve position controller, venting valve-regulating gas 224. For example, a pressure switch 250, which is set at the maximum pressure of gas transport storage vessels 212, may be used to vent pressure from the pneumatic line supplying valve-regulating gas 224 (i.e., to cause venting of valve-regulating gas 224, thereby terminating the filling period). When this pneumatic line is de-pressurized, the pressure-actuated inlet valve 222 closes and the fill is ended. The pressure switch may therefore serve as the valve position controller, in fluid communication with the gas transport storage vessels 212. According to this embodiment, the flow of gas is automatically shut-off from the fill station to gas transport storage vessels 212 at the preselected target pressure, which may be based on the pressure rating of the gas transport and may be adjusted (e.g., automatically) based on the measured, ambient temperature.

Overall, aspects of the invention are associated with processes and systems for filling gas storage vessels, with a number of advantageous features in terms of safety, ease of operation, reduced equipment and/or utility needs, increased efficiency, and/or other features apparent to those skilled in art consulting the present disclosure. Those having skill in the art, with the knowledge gained from the present disclosure, will recognize that various changes could be made in these processes and systems, without departing from the scope of the present invention. While in the foregoing specification the invention has been described in relation to certain preferred embodiments thereof, and details have been set forth for purpose of illustration, it will be apparent to those skilled in the art that the disclosure is susceptible to additional embodiments and that certain of the details described herein can be varied considerably without departing from the basic principles of the disclosure. Therefore, it should be understood that the features of the disclosure are susceptible to modification, alteration, changes or substitution without departing significantly from the spirit of the disclosure. For example, the dimensions, number, size and shape of the various components may be altered to fit specific applications. Accordingly, the specific embodiments illustrated and described herein are for illustrative purposes only, and not limiting of the invention as set forth in the appended claims.

The invention claimed is:

1. A process for filling a gas storage vessel, the process comprising:

providing a valve-regulating gas to a pressure-actuated inlet valve, at a valve pressure sufficient to cause a flow of product gas from an upstream end of a fill assembly, through said pressure-actuated inlet valve, and into said gas storage vessel at a downstream end of said fill assembly, wherein said valve pressure is controlled based on a comparison between an actual pressure and a target storage pressure of said gas storage vessel, said comparison being performed automatically by a valve position controller in fluid communication with both said gas storage vessel and said pressure-actuated inlet valve.

2. The process of claim 1, wherein said valve-regulating gas is provided, during a filling period, as a valve gas flow at said valve pressure.

3. The process of claim 2, wherein, when said actual pressure reaches or exceeds said target storage pressure, said filling period is automatically terminated, by an action of said valve position controller, stopping said valve gas flow.

4. A process for filling a gas storage vessel, the process comprising:

providing a valve-regulating gas to a pressure-actuated inlet valve, at a valve pressure sufficient to cause a flow of product gas from an upstream end of a fill assembly, through said pressure-actuated inlet valve, and into said gas storage vessel at a downstream end of said fill assembly, wherein said valve pressure is controlled based on a comparison between an actual pressure and a target storage pressure of said gas storage vessel, said comparison being performed automatically by a valve position controller in fluid communication with said gas storage vessel, wherein said valve-regulating gas is provided, during a filling period, at said valve pressure without flow.

5. The process of claim 4, wherein, when said actual pressure reaches or exceeds said target storage pressure, said filling period is automatically terminated, by an action from said valve position controller, venting said valve-regulating gas.

6. The process of claim 1, wherein said valve-regulating gas is provided to a first, valve gas side of a diaphragm of said pressure-actuated inlet valve, opposite a second, product gas side.

7. A process for filling a gas storage vessel, the process comprising:

providing a valve-regulating gas to a pressure-actuated inlet valve, at a valve pressure sufficient to cause a flow of product gas from an upstream end of a fill assembly, through said pressure-actuated inlet valve, and into said gas storage vessel at a downstream end of said fill assembly, wherein said valve pressure is controlled based on a comparison between an actual pressure and a target storage pressure of said gas storage vessel, said comparison being performed automatically by a pressure switch in fluid communication with said gas storage vessel, and wherein, when said actual storage pressure reaches or exceeds said target storage pressure, said pressure switch causes venting of said valve-regulating gas, terminating said filling period.

8. A process for filling a gas storage vessel, the process comprising:

providing a valve-regulating gas from said storage vessel to a pressure-actuated inlet valve, at a valve pressure sufficient to cause a flow of product gas from an upstream end of a fill assembly, through said pressure-actuated inlet valve, and into said gas storage vessel at a downstream end of said fill assembly, wherein said valve pressure is controlled based on a comparison between an actual pressure and a target storage pressure of said gas storage vessel, said comparison being performed automatically by a valve position controller in fluid communication with said gas storage vessel.

9. The process of claim 8, wherein said valve position controller remotely regulates said valve pressure.

10. A process for filling a gas storage vessel, the process comprising:

providing a valve-regulating gas from an air supply for pneumatic air brakes to a pressure-actuated inlet valve, at a valve pressure sufficient to cause a flow of product gas from an upstream end of a fill assembly, through said pressure-actuated inlet valve, and into said gas storage vessel at a downstream end of said fill assembly, wherein said valve pressure is controlled based on a comparison between an actual pressure and a target storage pressure of said gas storage vessel, said comparison being performed automatically by a valve position controller in fluid communication with said gas storage vessel.

11. The process of claim 1, wherein said product gas is compressed natural gas (CNG).

12. The process of claim 1, wherein said product gas is provided at said upstream end of said fill assembly, at a supply pressure of greater than about 3000 psig.

13. The process of claim 1, wherein said valve-regulating gas is provided to said pressure-actuated inlet valve at a valve pressure from about 25 psig to about 150 psig.

14. The process of claim 1, wherein said gas storage vessel is part of a gas transport module.

15. A system for filling a gas storage vessel, the system comprising:

a fill assembly having upstream and downstream ends, a connection for said gas storage vessel at said downstream end of said fill assembly, a pressure-actuated inlet valve separating said upstream end and said downstream end and configured to receive a valve-regulating gas, at a valve pressure sufficient to cause a flow of product gas from said upstream end into said gas storage vessel a valve position controller configured for fluid communication with both said gas storage vessel and said pressure-actuated inlet valve, and configured to automatically control said valve pressure based a comparison between an actual pressure and a target storage pressure of said gas storage vessel.

16. The system of claim 15, further comprising separate, first and second ports at said upstream end, for providing product gas at higher and lower pressures, respectively.

17. The system of claim 16, wherein said pressure actuated inlet valve is configured to cause flow of product gas from said first port only.

18. A gas transport module, comprising at least one gas storage vessel connected at said downstream end of said fill assembly of the system of claim 15.

19. A non-transitory computer readable medium having a computer program stored thereon, the computer program including instructions for causing a processor to perform the steps of:

receiving, during a filling period of a gas storage vessel, a signal representative of an actual pressure of said gas storage vessel; and comparing the actual pressure to a target storage pressure of said gas storage vessel, and, in the case of said actual pressure meeting or exceeding the target storage pressure, transmitting a signal to a valve position controller in fluid communication with a pressure-actuated inlet valve, to depressurize said pressure-actuated inlet valve, which terminates a flow of product gas to said gas storage vessel, at a valve pressure below a valve threshold pressure.

20. The computer readable medium of claim 18, wherein the target storage pressure is dependent on a measured, ambient temperature.

* * * * *